US005155966A

United States Patent [19]

Breidenbach et al.

[11] Patent Number: 5,155,966

[45] Date of Patent: Oct. 20, 1992

[54] ROOF STRUCTURE

[75] Inventors: Dieter Breidenbach, Bochum-Stiepel; Hans Oldengott, Hamm; Burckard Vitt, Lohmar, all of Fed. Rep. of Germany

[73] Assignee: Ruhrkohle AG, Essen, Fed. Rep. of Germany

[21] Appl. No.: 505,017

[22] Filed: Apr. 4, 1990

Related U.S. Application Data

[60] Division of Ser. No. 258,549, Oct. 17, 1988, Pat. No. 4,929,179, which is a continuation-in-part of Ser. No. 461, May 24, 1988.

[30] Foreign Application Priority Data

May 21, 1987 [DE] Fed. Rep. of Germany ..... 3717015

[51] Int. Cl.[5] ..... E04G 23/00

[52] U.S. Cl. ..... 52/747

[58] Field of Search ..... 52/741, 747

[56] References Cited

U.S. PATENT DOCUMENTS

| | | | |
|---|---|---|---|
| 3,340,832 | 9/1907 | Grisby | 52/747 X |
| 3,375,795 | 4/1968 | Merkle, Jr. | 52/747 X |
| 3,487,603 | 1/1970 | Roberts, Jr. | 52/747 |
| 4,287,024 | 9/1981 | Thompson | 202/263 X |
| 4,344,820 | 8/1982 | Thompson | 202/15 |
| 4,649,687 | 3/1987 | Harvey | 52/747 X |
| 4,754,591 | 7/1988 | Kastelic et al. | 52/747 |
| 4,917,772 | 4/1990 | Koschlig et al. | 110/173 RX |
| 4,929,179 | 5/1990 | Breidenbach et al. | 110/331 X |
| 4,932,187 | 6/1990 | Kraemer et al. | 52/747 |

*Primary Examiner*—David A. Scherbel
*Assistant Examiner*—Creighton Smith
*Attorney, Agent, or Firm*—Nils H. Ljungman & Associates

[57] ABSTRACT

A roof structure has a plurality of layers of heat resistant material, at least a first of the layers including a first brick layer, at least a second of the layers above the first of the layers including a heat resistant compound, and the heat resistant compound being unshaped when initially installed above the first of the layers. A method of forming a roof structure in an opening between side walls of a chamber includes the steps of installing at least one layer of bricks in the opening directly above the chamber, applying at least one layer of a first concrete in an unshaped form in the opening over the at least one layer of the bricks, tamping the at least one layer of the first concrete at at least a first predetermined temperature, and allowing the at least one layer of the first concrete to harden.

7 Claims, 1 Drawing Sheet

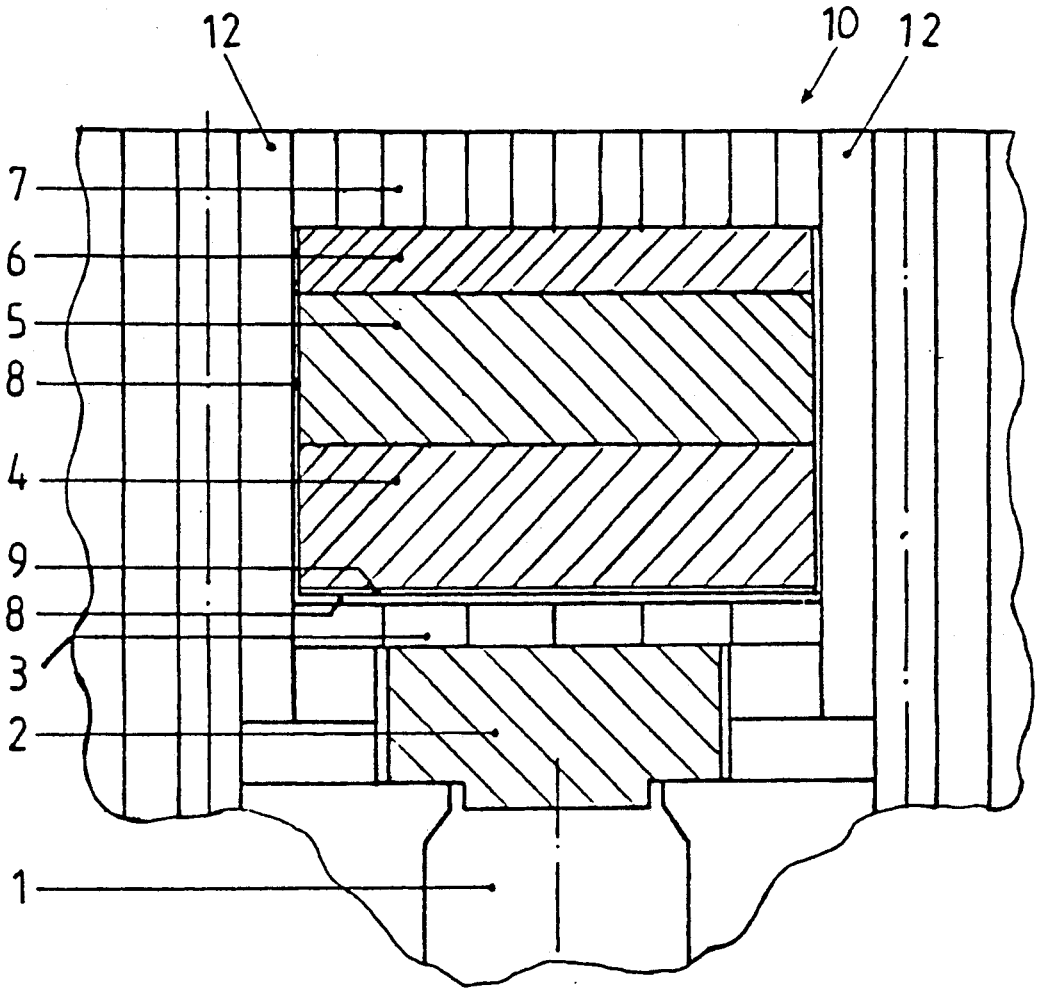
12
10
12
7
6
5
8
4
9
8
3
2
1

ROOF STRUCTURE

CROSS REFERENCE RELATED APPLICATIONS

This application is a divisional application of U.S. patent application Ser. No. 07/258,549 filed on Oct. 17, 1988, now U.S. Pat. No. 4,929,179, which was a continuation-in-part application of International Application No. PCT/EP88/00461 filed on May 24, 1988, in which the U.S. was a designated state, which claims priority from Federal Republic of Germany Patent Application No. P 37 17 015.5 filed on May 21, 1987.

BACKGROUND OF THE INVENTION

1. Field of the Invention

This invention relates to a roof structure and, more specifically, to such a roof structure which includes several layers of heat resistant material.

2. Description of the Prior Art

It is not uncommon for a roof structure to be formed of several courses or layers of bricks which have heat resistant characteristics. The roof structure is located basically in an opening which is between and defined by the upper ends of the side walls of a structure. The following sequence is frequently used to provide such a roof structure having heat resistant qualities. The bottommost layer of silica brick is laid in the lower part of the opening between the side walls and supported thereby. A layer of standard fireclay brick is laid over the silicon brick layer. The next layer would include lightweight refractory brick. A layer of standard insulating brick would then be laid on top of the lightweight refractory brick. Finally, the uppermost layer of the roof structure is formed by common red brick.

Although such roof structures have been employed in the past, it has always been recognized that the manufacture of heat resistant or refractory bricks of this type is very expensive. The expense of the refractory bricks is primarily due to the fact that so many special shapes are required. The special shapes are needed to insure proper integrity of the roof structure throughout extended use. In fact, it has also been found that the need for such integrity has significantly added to the design costs of providing such a roof structure because of the need to specifically design each of the many special shapes of refractory bricks. In addition to the design costs, the requirement for many shapes of the refractory bricks significantly extends the overall design-to-completion time. Since each of the different shapes must be specifically produced, the increased manufacturing time can significantly add to the overall cost of the project of providing the desired roof structure. Finally, when the refractory bricks are available, the actual assembly costs are elevated because of the additional labor time and skill required to assemble the roof structure with the refractory bricks having different shapes.

Even with such design requirements and care in assembly, there is a continuing concern that roof structures formed of such refractory brick will be susceptible to gas penetration after initial assembly and throughout extended use of the roof structure. Accordingly, any type of roof structure which can reduce the design, manufacture and assembly expenses and which would tend to remain more effective for preventing penetration of gas would clearly be desirable.

OBJECTS OF THE INVENTION

It is therefore an object of the invention to provide a roof structure which is less expensive to design, manufacture and construct.

It is another object to provide such a roof structure which significantly reduces the requirement for refractory bricks having many special shapes.

It is a further object to provide such a roof structure which effectively reduces or prevents the penetration of gas.

SUMMARY OF THE INVENTION

These and other objects of the invention are provided in a preferred embodiment thereof including a roof structure which has a plurality of layers of heat resistant material. At least a first of the layers includes a first brick layer. At least a second of the layers above the first of the layers includes a heat resistant compound. The heat resistant compound is unshaped when initially installed above the first of the layers.

The objects of the invention are also provided by a preferred method of forming a roof structure in an opening between side walls of a chamber. The method includes the step of installing at least one layer of bricks in the opening directly above the chamber. Further, there is included the step of applying at least one layer of a first concrete in the opening over the one layer of bricks. The method then includes the tamping of the one layer of the first concrete at at least a first predetermined temperature. Finally, the one layer of first concrete is allowed to harden.

The preferred invention has particular application to providing a roof structure which can serve as a coke oven roof which includes several layers of refractory material. Conventional coke oven roofs consist of several courses of refractory brick. The following sequence is frequently used; the bottommost layer is silica brick, with standard fireclay brick over that, then standard lightweight refractory brick, and standard insulating brick on top of that. The uppermost layer of the oven roof is formed by common red brick. The manufacture of refractory bricks is very expensive, primarily because so many special shapes are required. The object of the invention, therefore, is to reduce the construction expense for the manufacture of oven roofs.

According to the invention, the object is achieved by using, as far as possible, unshaped refractory compounds, in particular refractory concretes, instead of refractory bricks. Refractory compounds are compounds which an withstand temperatures of 1500° C. to 1700° C. They include fire-resisting compounds (up to 1500° C.) and highly refractory compounds (above 1700° C.). Refractory concretes are unshaped compounds with a concrete-hydraulic bond which at the appropriate conditions is converted to a ceramic bond at elevated temperatures. The refractory concretes can be introduced as tamping clays. One advantage of the use of tamping clays is that they make the production of special shapes unnecessary.

Refractory concretes are preferably used between the fireclay layer and the uppermost layer of bricks of the oven roof. Surprisingly, however, it has been discovered that the temperature in the oven roof is thereby lower than with comparable oven roofs made of refractory bricks. It has also been demonstrated that the oven roofs with the refractory concrete layers very effectively prevent the penetration of gas.

BRIEF DESCRIPTION OF THE DRAWING

The FIGURE illustrates a fragmentary, sectional view of a preferred roof structure including one embodiment of the invention.

DESCRIPTION OF THE PREFERRED EMBODIMENTS

The FIGURE shows a transverse cross section of a preferred roof structure 10 which is at right angles to the longitudinal direction of the oven. The oven chamber 1 is enclosed on both sides by side walls 12 and by the preferred roof structure or furnace roof 10 at the top thereof. The oven is 390 to 430 mm wide. The bottommost layer in the oven roof structure 10 comprises silica bricks 2. The silica bricks 2 are refractory bricks and form a layer which is 220 mm high in the preferred embodiment as illustrated. Above the silica bricks 2 are standard fireclay bricks 3. The standard fireclay bricks 3 are again refractory bricks. In contrast to an oven roof structure of the prior art with two courses of fireclay bricks, however, there is only one course of fireclay bricks 3. The thickness of the fireclay refractory bricks 3 is 70 mm. The oven roof structure is closed at top thereof by a layer of common red bricks 7. The common red bricks 7 in the top layer are laid lengthwise on their narrow side.

Between the layer of common red bricks 7, which has a conventional thickness of 130 mm, and the layer of fireclay bricks 3, there are various refractory concrete layers, in the following sequence from bottommost to topmost:

Light refractory concrete, insulating concrete, light refractory concrete.

The bottom layer 4 of light refractory concrete is 200 mm thick and the top layer 6 is 100 mm thick. The insulating concrete layer 5 in between is 250 mm thick.

The light refractory concrete layer has the following specification:

| | | |
|---|---|---|
| $Al_2O_3$ content: | 26.6% | |
| $SiO_2$ content: | 45.7% | |
| $Fe_2O_3$ content: | 8.7% | |
| Cold bending strength | 1000° C. | 17 kp/cm$^2$ |
| with preliminary firing | 1100° C. | 26 kp/cm$^2$ |
| Thermal conductivity at | 600° C. | 0.41 kcal/mh °C. |
| | 800° C. | 0.40 kcal/mh °C. |
| | 1000° C. | 0.43 kcal/mh °C. |
| Refractoriness: | SK 8 | 1295° C. |
| Max. use temperature: | | 1100° C. |

The insulating concrete layer has the following specification:

| | | |
|---|---|---|
| $Al_2O_3$ content: | 26.8% | |
| $SiO_2$ content: | 33.2% | |
| $Fe_2O_3$ content: | 11.9% | |
| Cold bending strength | 10 kp/cm$^2$ | |
| with preliminary firing 100° C. | | |
| Thermal conductivity at | 400° C. | 0.15 kcal/mh °C. |
| | 600° C. | 0.17 kcal/mh °C. |
| | 800° C. | 0.19 kcal/mh °C. |
| Refractoriness: | SK 7 | 1270° C. |
| Max. use temperature: | | 1020° C. |

Between the refractory concrete region and the other refractory bricks there is an expansion joint 8 of 10 mm. The expansion joint 8 is filled with a silicate fiber material (¾ inch ceramic fiber). The silicate layer forming the expansion joint 8 can be resealed if gas leaks occur. Moreover, in the horizontal section of the expansion joint 8 there is a metal foil 9 which, in the preferred embodiment, is an aluminum foil 0.3 mm thick. Such an expansion joint 8 guarantees that no expansion damage will occur when the masonry heats up. The aluminum foil also offers a significant insulating action and provides a seal against gas penetration.

The assembly of the oven wall proceeds normally, and the chamber roof bricks are laid in a manner well known in the coke oven art. Over them is laid the standard layer of fireclay bricks 3. The small heating walls (inspection hole walls) consist of fireclay bricks or prefabricated components. In the open spaces between the charging hole shafts and the top reflectors in the direction of the chamber axis and the heating walls in the direction of the battery axis, the refractory concrete is applied in layers. The installation is done by tamping the compound. The bottom layer of light refractory concrete or cement 4 is installed at a heating up temperature of approximately 55° C., while the insulating concrete 5 and the top layer of light refractory concrete 6 are applied at a heating up temperature of approximately 900° C. All the refractory concrete layers are kept moist for at least 30 hours after application. In one method of assembling the preferred roof structure 10, the bottom layer of light refractory concrete is substantially hardened after the 30 hours and the temperature is elevated to allow the application and tamping of the insulating concrete 5. After another 30 hours in which the insulating concrete 5 is kept moist, the top layer of light refractory concrete 6 is applied and tamped at the elevated temperature. Again, the top layer of the light refractory concrete 6 is kept moist for at least 30 hours. The temperatures and the other application parameters are determined as a function of the expansion behavior of the silica material used in the substructure.

Shortly before the chambers 1 are charged for the first time, the oven roof structure 10 is closed by the installation of the course in which the bricks 7 are laid lengthwise on their narrow side.

The roof according to the invention costs approximately 50% less than a roof with conventional masonry. Moreover, there is a significantly lower temperature in the oven roof and on the surface of the oven roof.

A number of patents disclose coke oven configurations and equipment associated with the operation thereof. These patents, which are incorporated as if disclosed in their entirety herein, include the following: U.S. Pat. Nos. 4,077,848; 4,244,786; 4,406,619; 4,512,080: 4,666,559; 4,673,463: and 4,749,446.

In summing up, one aspect of the invention resides broadly in a coke oven roof comprising several layers of refractory material, characterized by the fact that above one or more layers 2, 3 consisting of refractory bricks covering the oven chamber, there is at least one layer of unshaped refractory compound.

Another aspect of the invention resides broadly in the preferred unshaped refractory compound which is in the form of several layers of refractory concrete 4, 5, 6.

Yet another aspect of the invention resides broadly in a coke oven roof characterized by the fact that the refractory concrete has an $Al_2O_3O_3$ content of 25 to 28%, an $SiO_2$ content of 30 to 50%, and an $Fe_2O_3$ content of 8 to 12%.

A further aspect of the invention resides broadly in a coke oven roof characterized by different refractory concrete layers on top of one another with various thicknesses and thermal conductivities.

A yet further aspect of the invention resides broadly in a coke oven roof characterized by the fact that there is a bottom refractory concrete layer 4 of light refractory concrete and an upper refractory concrete layer of light refractory concrete 6, and between them, a layer of insulating concrete 5.

Yet another further aspect of the invention resides broadly in a coke oven roof characterized by the fact that there is an expansion joint 8 between the refractory concrete layer and the refractory bricks.

An additional aspect of the invention resides broadly in a coke oven roof characterized by the fact that the expansion joint 8 is filled with a layer of silicate fiber material.

A yet additional aspect of the invention resides broadly in a coke oven roof characterized by the fact that there is a metal foil 9 in the expansion joint 8.

A further additional aspect of the invention resides broadly in a coke oven roof characterized by the fact that the metal foil is aluminum.

A yet further additional aspect of the invention resides broadly in a coke oven roof characterized by the fact that the installation and treatment of the various refractory concrete layers is done as a function of the hot draft temperatures.

Another further additional aspect of the invention resides broadly in a coke oven roof characterized by the fact that the bottom light refractory concrete layer 4 is tamped at a heating up temperature of 50° to 60° C.

A yet another further additional aspect of the invention resides broadly in a coke oven roof characterized by the fact that the top layer of light refractory concrete and/or the intervening insulating concrete layer 5 is tamped at a temperature of 850° to 950° C.

Another yet further aspect of the invention resides broadly in a coke oven roof characterized by the fact that the oven roof is closed by the laying of the common red brick layer 7 shortly before the initial charging.

The invention as described hereinabove in the context of a preferred embodiment is not to be taken as limited to all of the provided details thereof, since modifications and variations there of may be made without departing from the spirit and scope of the invention.

What is claimed is:

1. A method of forming a roof structure in an opening between side walls of a chamber comprising the steps of:

installing at least one layer of bricks in said opening directly above said chamber;

applying at least one layer of a first concrete in an unshaped form in said opening over said at least one layer of said bricks;

tamping said at least one layer of said first concrete at at least a first predetermined temperature; and allowing said at least one layer of said first concrete to harden.

2. The method according to claim 1, further including the step of keeping said at least one layer of said first concrete moist for at least 30 hours after said applying.

3. The method according to claim 2, further including the steps of applying a layer of a second concrete in an unshaped form in said opening over said at least one layer of said first concrete, tamping said layer of said second concrete at a second predetermined temperature and allowing said layer of said second concrete to harden.

4. The method according to claim 3, further including the steps of applying another layer of said first concrete in an unshaped form in said opening over said layer of said second concrete, tamping said another layer of said first concrete at said second predetermined temperature and allowing said another layer of said first concrete to harden.

5. The method according to claim 4, wherein said chamber is a coke oven chamber, said first bricks are refractory bricks, said first concrete is a light refractory concrete, and said second concrete is an insulating concrete.

6. The method according to claim 4, wherein said tamping of said at least one layer of said first concrete is at said first predetermined temperature of about 50° C. to about 60° C. and said tamping of said layer of said second concrete and said tamping of said another layer of said first concrete are at said second temperature of about 850° C. to about 950° C.

7. The method according to claim 4, further including the step of laying a layer of common red brick over said another layer of said first concrete.

* * * * *

UNITED STATES PATENT AND TRADEMARK OFFICE

CERTIFICATE OF CORRECTION

PATENT NO. : 5,155,966

DATED : October 20, 1992

INVENTOR(S) : Dieter BREIDENBACH, Hans OLDENGOTT, Burckard VITT

It is certified that error appears in the above-identified patent and that said Letters Patent is hereby corrected as shown below:

On the title page, under the Related U.S. Application Data Section, item 60, lines 2-3, after 'of', delete "Ser. No. 461," and insert --International Application No. PCT/EP88/00461,--.

Column 3, line 57, in the Table, line 5, after 'firing', delete "100°C." and insert --110°C.--.

Column 4, line 64, after 'an', delete "$Al_2O_3O_3$" and insert --$Al_2O_3$--.

Column 5, line 22, after 'foil', insert --9--.

Signed and Sealed this

Twenty-third Day of November, 1993

*Attest:*

*Attesting Officer*

Bruce Lehman

BRUCE LEHMAN

*Commissioner of Patents and Trademarks*